US006747600B2

(12) United States Patent
Wong et al.

(10) Patent No.: US 6,747,600 B2
(45) Date of Patent: Jun. 8, 2004

(54) DUAL-BAND MONOPOLE ANTENNA

(75) Inventors: Kin Lu Wong, Kaohsiung (TW); Yen Liang Kuo, Tainan (TW)

(73) Assignee: Accton Technology Corporation, Hsinchu (TW)

( * ) Notice: Subject to any disclaimer, the term of this patent is extended or adjusted under 35 U.S.C. 154(b) by 70 days.

(21) Appl. No.: 10/140,167

(22) Filed: May 8, 2002

(65) Prior Publication Data

US 2003/0210187 A1 Nov. 13, 2003

(51) Int. Cl.[7] ..... H01Q 1/38
(52) U.S. Cl. ..... 343/700 MS; 343/846
(58) Field of Search ..... 343/700 MS, 792.5, 343/795, 829, 846, 848

(56) References Cited

U.S. PATENT DOCUMENTS 3,599,217 A * 8/1971 Grant ..... 343/792.5
5,712,643 A * 1/1998 Skladany ..... 343/700 MS
6,008,774 A 12/1999 Wu
6,094,176 A * 7/2000 Van Hoozen et al. .... 343/792.5
6,166,694 A 12/2000 Ying
6,307,524 B1 * 10/2001 Britain ..... 343/795
6,483,476 B2 * 11/2002 Cox ..... 343/815

* cited by examiner

*Primary Examiner*—Tho Phan
(74) *Attorney, Agent, or Firm*—Lowe Hauptman Gilman & Berner LLP

(57) ABSTRACT

This invention discloses a dual-band monopole antenna, which can be operated in dual bands and easily tuned to the frequency band required for WLAN system by means of adjusting the frequencies of the resonant mode of the antenna. The dual-band monopole antenna of the invention mainly includes a microwave substrate having a first surface and a second surface, a first horizontal radiating metallic line, a second horizontal radiating metallic line, a vertical radiating metallic line, a feeding point, and a ground plane. The microwave substrate includes a first surface and a second surface. The first horizontal radiating metallic line is printed on the first surface. The second horizontal radiating metallic line is printed on the first surface. The vertical radiating metallic line is printed on the first surface, wherein the first horizontal radiating metallic line and the second horizontal radiating metallic line respectively intersect the vertical radiating metallic line at different positions. The feeding point is disposed on the vertical radiating metallic line, and a ground plane is printed on the second surface of the microwave substrate.

20 Claims, 6 Drawing Sheets

DUAL-BAND MONOPOLE ANTENNA

BACKGROUND OF THE INVENTION

1. Field of the Invention

This invention relates to an antenna system, and more particularly to a dual-band monopole antenna for the wireless local area network (WLAN) system.

2. Description of the Related Art

With the development of the communication industry in recent years, markets of the WLAN have been gradually growing. In conventional techniques, there have been developed many antennas used in wireless communication devices, such as U.S. Pat. No. 6,166,694 issued to Ying on Dec. 26, 2000 entitled "Printed twin spiral dual band antenna," which discloses a communication device for the wireless communication system. The communication device includes a printed circuit board, a dielectric substrate adhered on the printed circuit board, and an antenna printed on the dielectric substrate. However, the antenna is printed on the dielectric substrate and then disposed on the printed circuit board by the surface mounted technology, so the cost of the final product is high and, in addition, the antenna occupies quite a large area, which does not meet the demand for reduced volumes of current electronic products.

U.S. Pat. No. 6,008,774 issued to Wu on Dec. 28, 1999 entitled "Printed antenna structure for wireless data communication," which discloses a printed antenna used for laptop computers in WLAN or other types of small, portable, wireless data communication products including a printed circuit board, a hook-shaped radiating metallic line printed on the top surface of the printed circuit board, a feeding point connected to the hook-shaped radiating metallic line, and a ground plane printed on the bottom surface of the printed circuit board. Compared with the above mentioned patent, this invention is characterized in that the antenna is printed on a peripheral card and directly integrated with the system circuit on the peripheral card. However, the antenna is only used for WLAN operation in the 2.4 GHz band.

Accordingly, many antennas in the wireless communication network card equipped in various types of the current electronic products are only operated in a single frequency band. Therefore, it is expected that, with the growing of the market, the performance and the market competitiveness of the wireless communication network card equipped with the antenna that is operated only in a single frequency band are insufficient. Accordingly, to develop the antenna in the wireless communication network card capable of operating in dual bands is the mainstream trend of related electronic products.

In addition, current electronic products are designed to be light, thin, short and small, so it is expected that the volume of the wireless communication card equipped in all types of electronic products will have the light, thin and clever features and appearances. In this condition, the volume of the antenna equipped in the wireless communication network card will be confined in a specific volume.

Accordingly, there exists a need to provide an antenna capable of easily operating in dual bands and suitable for WLAN operation, and the antenna has the light, thin and small features so as to meet the reduced-volume requirement of current electronic products.

SUMMARY OF THE INVENTION

It is a primary object of the present invention to provide a dual-band monopole antenna which can be operated in dual bands and easily tuned to the frequency band required for WLAN operation by means of adjusting the resonant frequencies of the antenna.

It is another object of the present invention to provide a dual-band monopole antenna, wherein the antenna occupies a minimum area and is integrated with the system circuit of the microwave substrate.

In order to achieve the above objects, a dual-band monopole antenna of the present invention comprises a microwave substrate, a first horizontal radiating metallic line, a second horizontal radiating metallic line, a vertical radiating metallic line, a feeding point, and a ground plane. The microwave substrate includes a first surface and a second surface. The first horizontal radiating metallic line is printed on the first surface. The second horizontal radiating metallic line is printed on the first surface. The vertical radiating metallic line is printed on the first surface, wherein the first horizontal radiating metallic line and the second horizontal radiating metallic line respectively intersect the vertical radiating metallic line at different positions. The feeding point is disposed on the vertical radiating metallic line, and the ground plane is printed on the second surface of the microwave substrate.

According to one aspect of the present invention, the middle point of the first horizontal radiating metallic line is connected to one end of the vertical radiating metallic line or the vicinity thereof opposite to the feeding point, the middle point of the second horizontal radiating metallic line is connected to the vertical radiating metallic line at the position different from where the first horizontal radiating metallic line connected to, and two ends (free ends) of the two horizontal radiating metallic lines are extended outwards in opposite direction, whereby the antenna is formed as an stacked double T shape.

According to another aspect of the present invention, the path from the feeding point through the vertical radiating metallic line to one of the free end of the first horizontal radiating metallic line forms a first resonant path of the antenna in operation and determines the first (the lower) operating frequency thereof, and the path from the vertical radiating metallic line to one of the free end of the second horizontal radiating metallic line forms a second resonant path of the antenna in operation and determines the second (the higher) operating frequency thereof.

According to a further aspect of the present invention, the feeding point is connected to a feeding metallic line for signal transmission.

According to a still further aspect of the present invention, the feeding metallic line is printed on the first surface.

According to the present invention, tuning of the above-mentioned two resonant frequencies of the antenna is very easy by means of adjusting the lengths of the first and second horizontal radiating metallic lines, and further tuning the antenna to the frequency band required. In addition, the antenna of the present invention is a planar structure, and therefore it has high integration with the microwave electric circuit. The antenna according to one embodiment of the present invention can be operated in dual bands at 2.4 GHz and 5.2 GHz for WLAN operations, and has a desirable antenna gain in the operating frequency bands.

BRIEF DESCRIPTION OF THE DRAWINGS

Other objects, advantages, and novel features of the invention will become more apparent from the following detailed description when taken in conjunction with the accompanying drawings.

DETAILED DESCRIPTION OF THE PREFERRED EMBODIMENT

Figure 1:
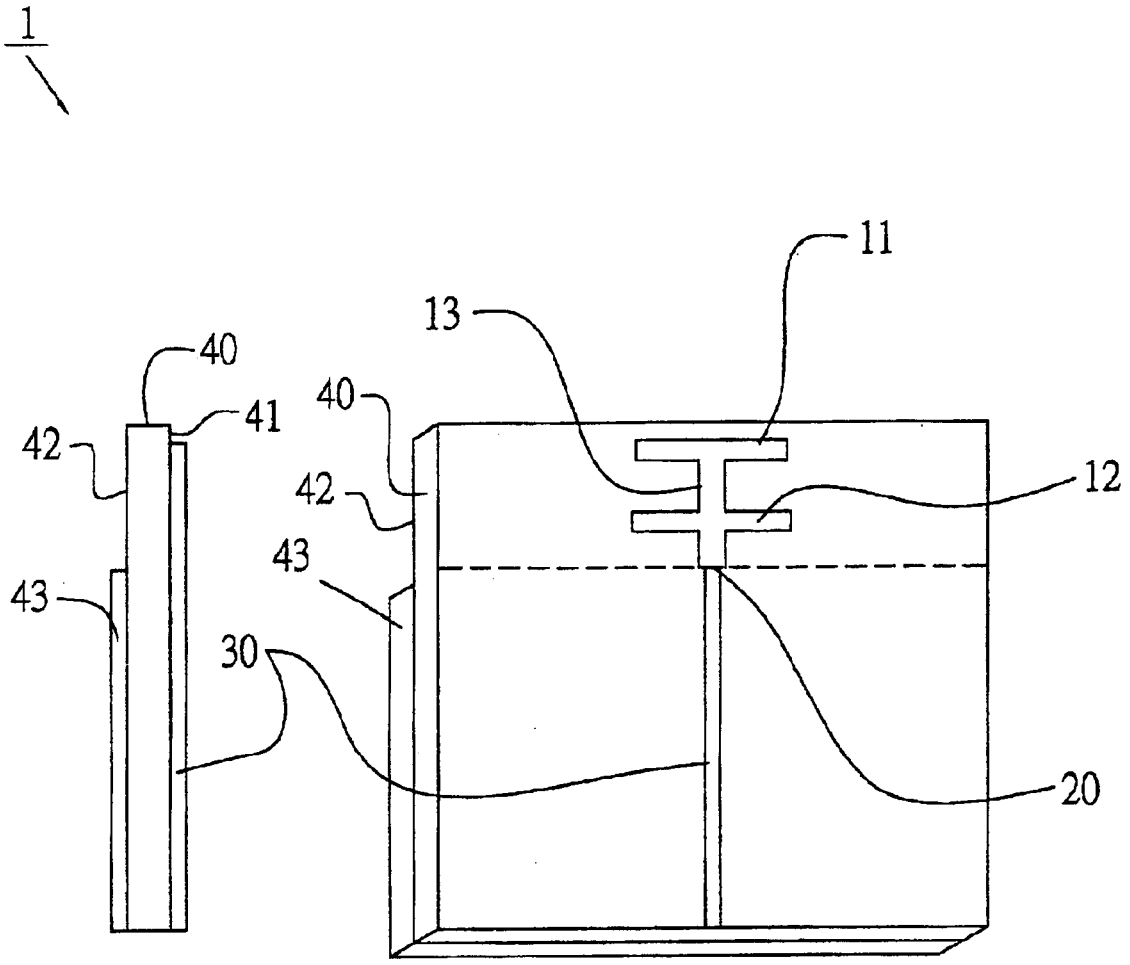
FIG. 1 are perspective view and sectional view of a dual-band monopole antenna in accordance with an embodiment of the present invention

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring to FIG. 1, it depicts the dual-band monopole antenna 1 in accordance with the present invention mainly comprising: a microwave substrate 40 with a first surface 41 and a second surface 42. The first surface 41 has a feeding metallic element 30, which is preferably a microstrip line of characteristic impedance 50 Ω for signal transmission. A first horizontal radiating metallic line 11 is printed on the first surface 41. A second horizontal radiating metallic line 12 is printed on the first surface 41 and below the first horizontal radiating metallic line 11. A vertical radiating metallic line 13 is printed on the first surface 41 and is substantially in perpendicular to the first horizontal radiating metallic line 11 and the second horizontal radiating metallic line 12. A feeding point 20 is disposed on the vertical radiating metallic line 13 for connecting the feeding metallic element 30 to the vertical radiating metallic line 13 so as to transmit signals. A ground plane 43 is printed on the second surface 42 and served as a ground plane of a wireless communication card, and the ground plane 43 has a rectangular or substantially rectangular breach, over which the antenna 1 is directly disposed. In this embodiment, the middle point of the first horizontal radiating metallic line 11 is connected to one end of the vertical radiating metallic line 13 or the vicinity thereof opposite to the feeding point 20, while the middle point of the second horizontal radiating metallic line 12 is connected to the vertical radiating metallic line 13 at the position different from where the first horizontal radiating metallic line 11 is connected to, wherein the two ends (free ends) of the two horizontal radiating metallic lines 11 and 12 extend outwards in the opposite direction and thus the antenna 1 is formed as a stacked double T shape.

It depicts the microwave substrate 40 according to the present invention which is constructed by a circuit board of a wireless communication network card which is 45×80 $mm^2$ in size. The microwave substrate 40 is generally formed by a printed circuit board made of BT (bismaleimide-triazine) resin, FR4 fiberglass reinforced epoxy resin, a flexible film substrate made of polyimide, or a substrate with good performance in high frequency made of Teflon or ceramics e.g. $Al_2O_3$ or $MgTiO_3$. Due to the planar characteristic of the designed structure of the antenna 1, it has high integration with the system circuit of the microwave substrate 40, whereby the light, thin and small-area characteristics can be obtained and the reduced-volume requirement of current electronic products can be met.

As mentioned above, the path from the feeding point 20 through the vertical radiating metallic line 13 to one of the free end of the first horizontal radiating metallic line 11 forms the first resonant path of the antenna 1 in operation and determines the first (the lower) operating frequency of the antenna 1. In addition, the path from the feeding point 20 through the vertical radiating metallic line 13 to one of the free end of the second horizontal radiating metallic line 12 forms the second resonant path of the antenna 1 in operation and determines the second (the higher) operating frequency of the antenna 1. Also note that, probably because there is small coupling between the first and the second resonant paths in the present invention, the first and the second operating frequencies for the desired dual-band WLAN operations can be easily tuned by means of respectively adjusting the lengths of the first horizontal radiating metallic line 11 and the second horizontal radiating metallic line 12.

Figure 2:
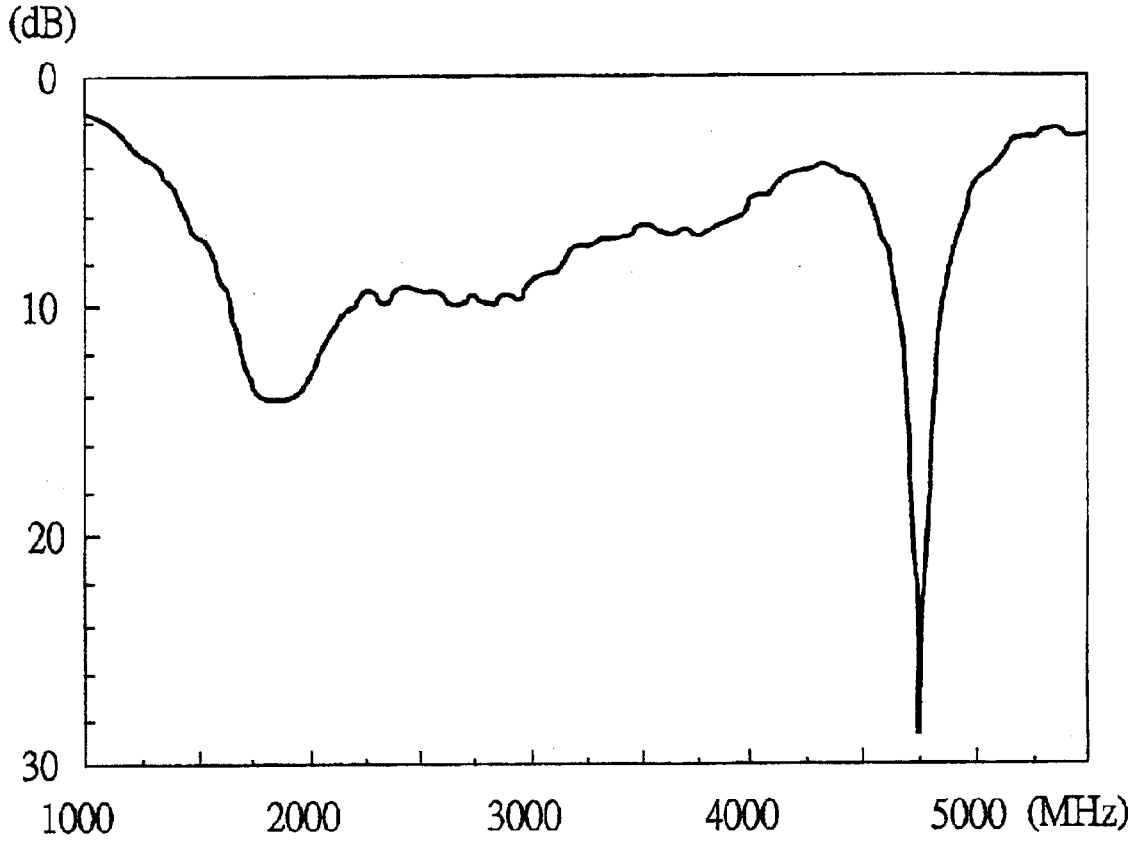
FIG. 2 is a diagram of the measured results showing the return loss of the dual-band monopole antenna in accordance with an embodiment of the present invention.
Figure 5:
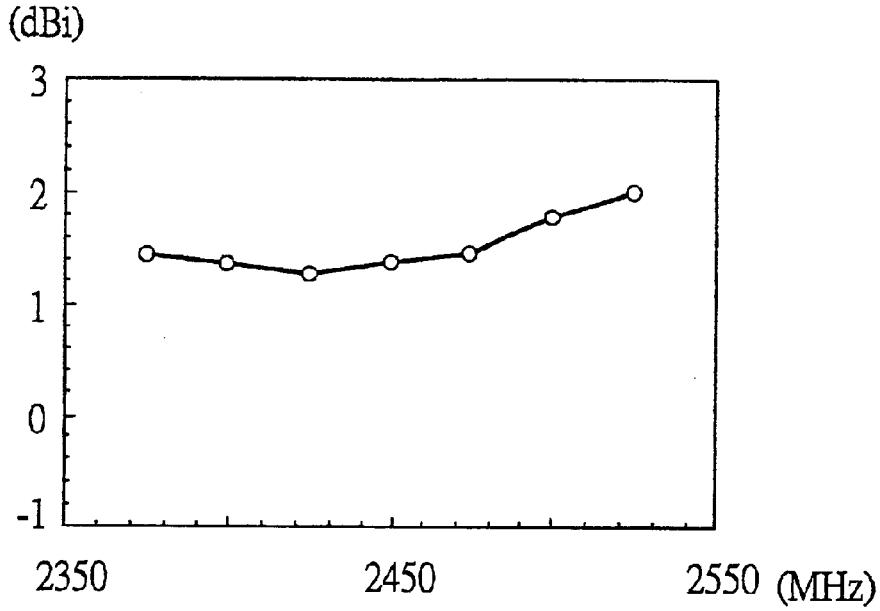
FIG. 5 is a diagram of the measured results showing the antenna gain of the dual-band monopole antenna in the 2.4 GHz band for WLAN operation in accordance with an embodiment of the present invention.
Figure 6:
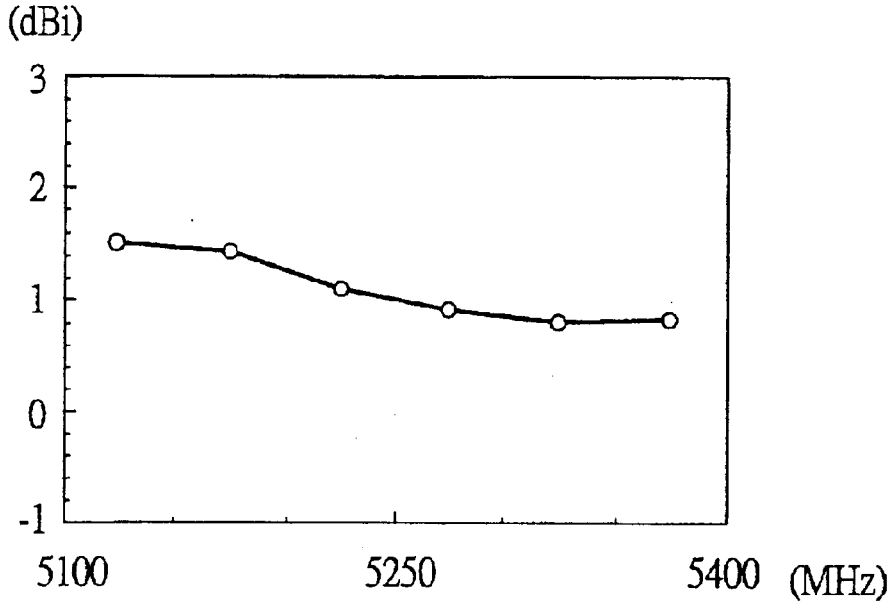
FIG. 6 is a diagram of the measured results showing the antenna gain of the dual-band monopole antenna in the 5.2 GHz band for WLAN operation in accordance with an embodiment of the present invention.

The experimental results of the dual-band monopole antenna 1 in accordance with the present invention are shown in FIG. 2 and FIG. 6. The experimental results of FIG. 2 to FIG. 6 are obtained under the condition that the microwave substrate 40 has a dielectric constant 4.4 and is 0.8 mm in thickness; the dual-band monopole antenna 1 is 14.5×18 $mm^2$ in dimension; the first horizontal radiating metallic line 11 is 1 mm in length and 1.5 mm in width; the second horizontal radiating metallic line 12 is 18 mm in length and 3.5 mm in width; the vertical radiating metallic line 13 is 14.5 mm in length and 3.5 mm in width.

FIG. 2 depicts that, under the condition (definition) that the return loss equals to 10 dB, the bandwidth of the first (the lower) operating mode of the antenna 1 is 540 MHz (2205–2745 MHz) and the bandwidth of the second (the higher) operating mode thereof is 210 MHz (5145–5355 MHz), wherein the operating bandwidth can cover the bandwidth required for the 2.4 GHz (2400–2484 MHz) and 5.2 GHz (5150–5350 MHz) bands for WLAN operations.

Figure 3:
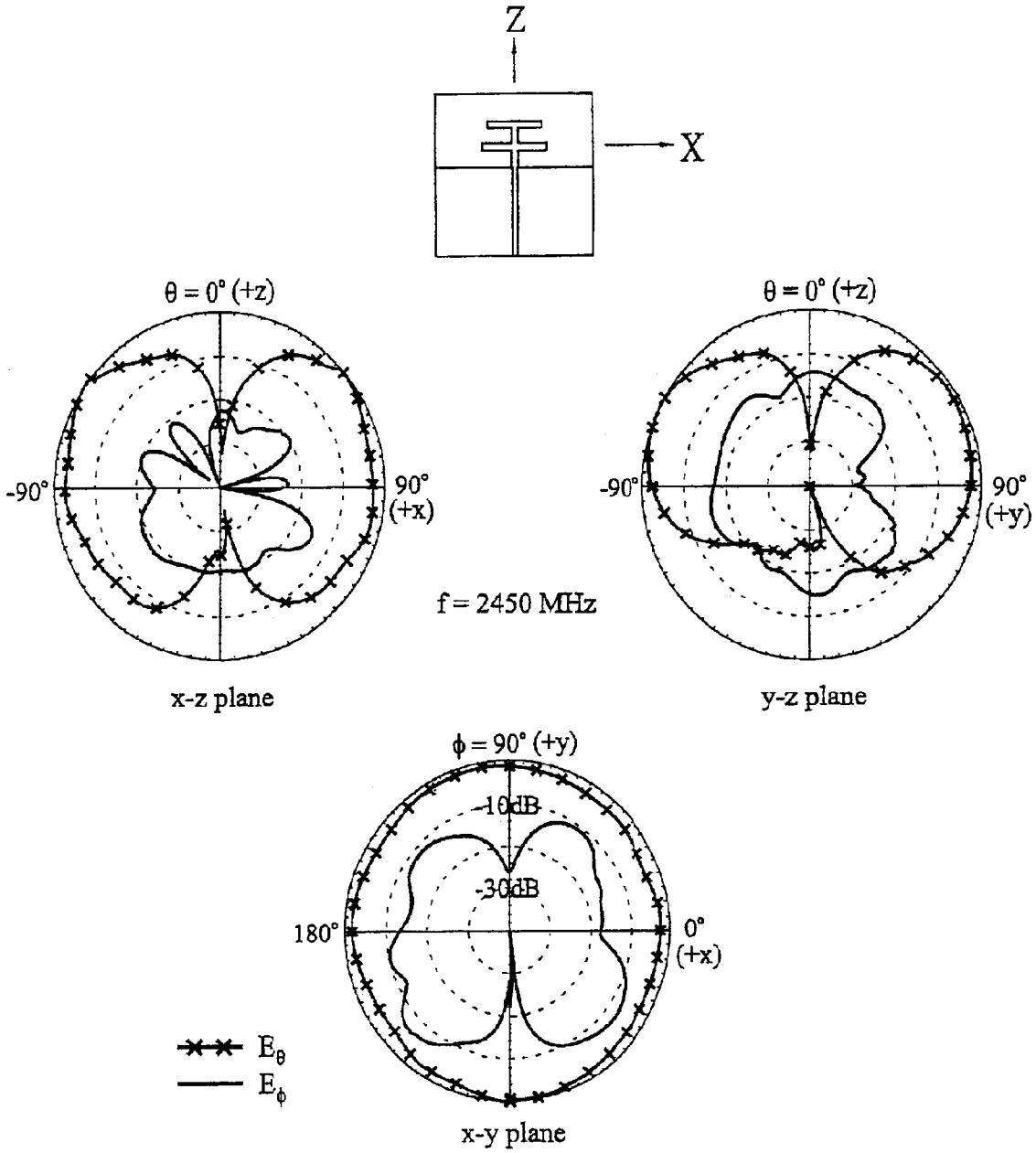
FIG. 3 is a diagram of the measured results showing the radiation pattern of the antenna in accordance with an embodiment of the present invention at 2450 MHz.
Figure 4:
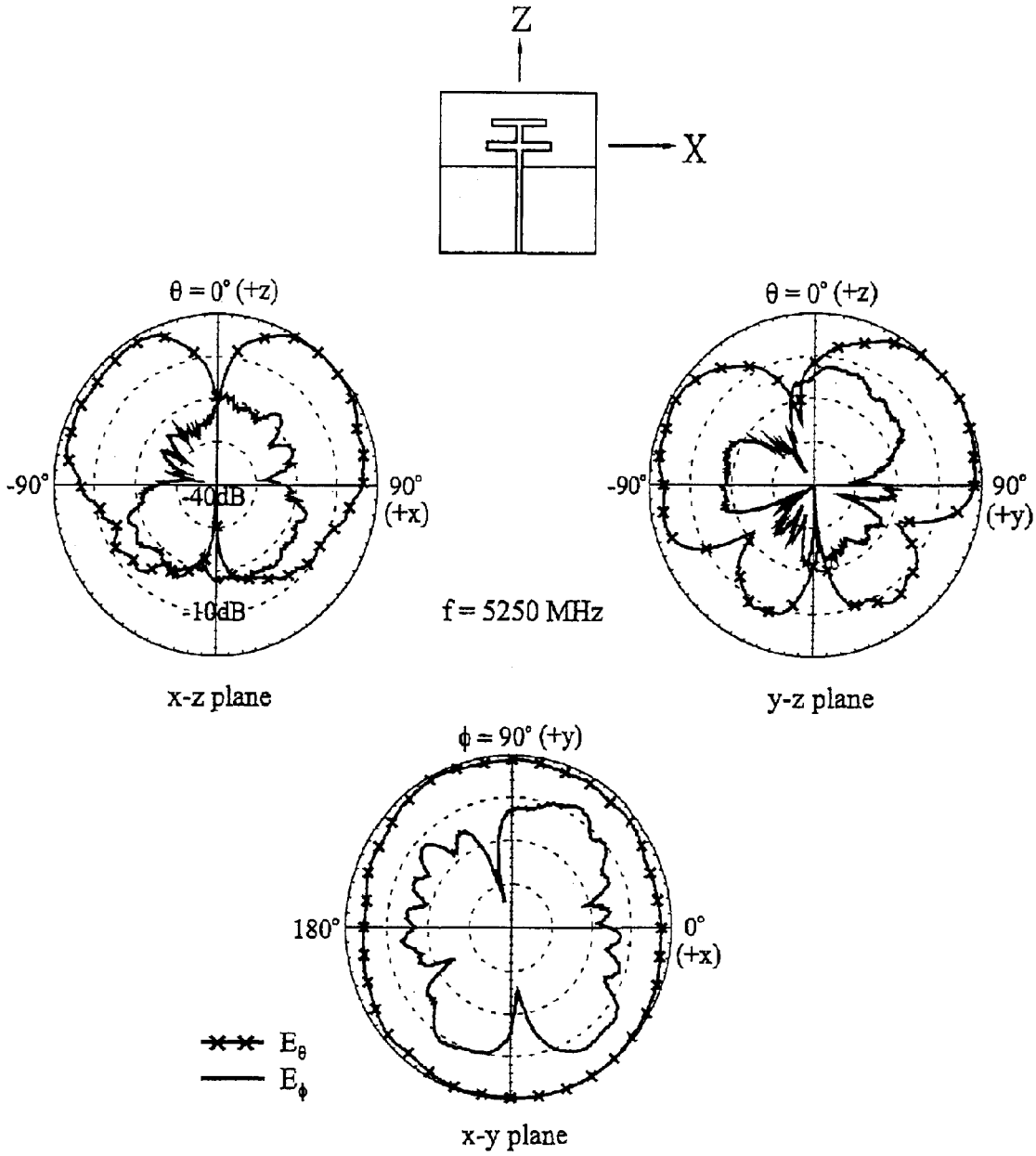
FIG. 4 is a diagram of the measured results showing the radiation pattern of the antenna in accordance with an embodiment of the present invention at 5250 MHz.

FIG. 3 and FIG. 4 are the measured radiation patterns of the embodiment operated at 2450 MHz and 5250 MHz; the radiation patterns of both operation are observed to be about axially symmetric.

FIG. 5 and FIG. 6 depict the measured results of the antenna gain of the antenna 1 operated respectively in the 2.4 GHz band and 5.2 GHz band. In the 2.4 GHz band, the antenna gain is between about 1.3 dBi and about 2.0 dBi, and in the 5.2 GHz band, the antenna gain is between about 0.8 dBi and about 1.5 dBi, and thus it has been found that the antenna 1 in both of the first and second operating modes is provided with desirable antenna gain.

Figure 7A:
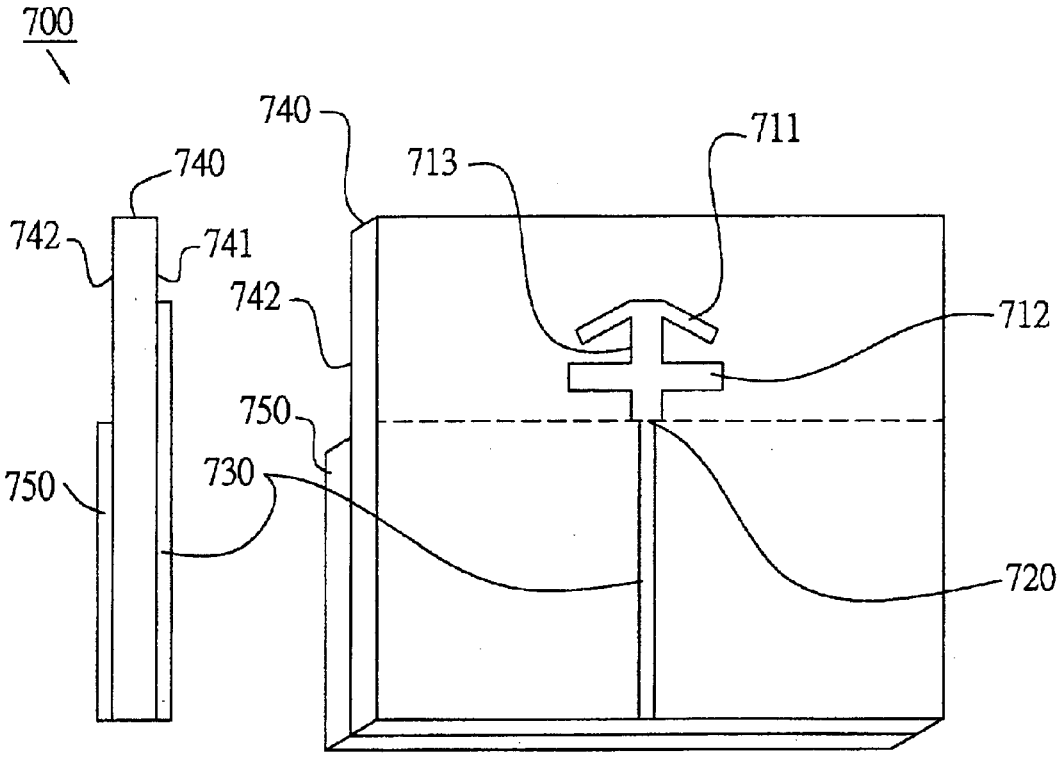
FIG. 7*a* through FIG. 7*b* are perspective views and sectional views of dual-band monopole antennas in accordance with other embodiments of the present invention.
Figure 7B:
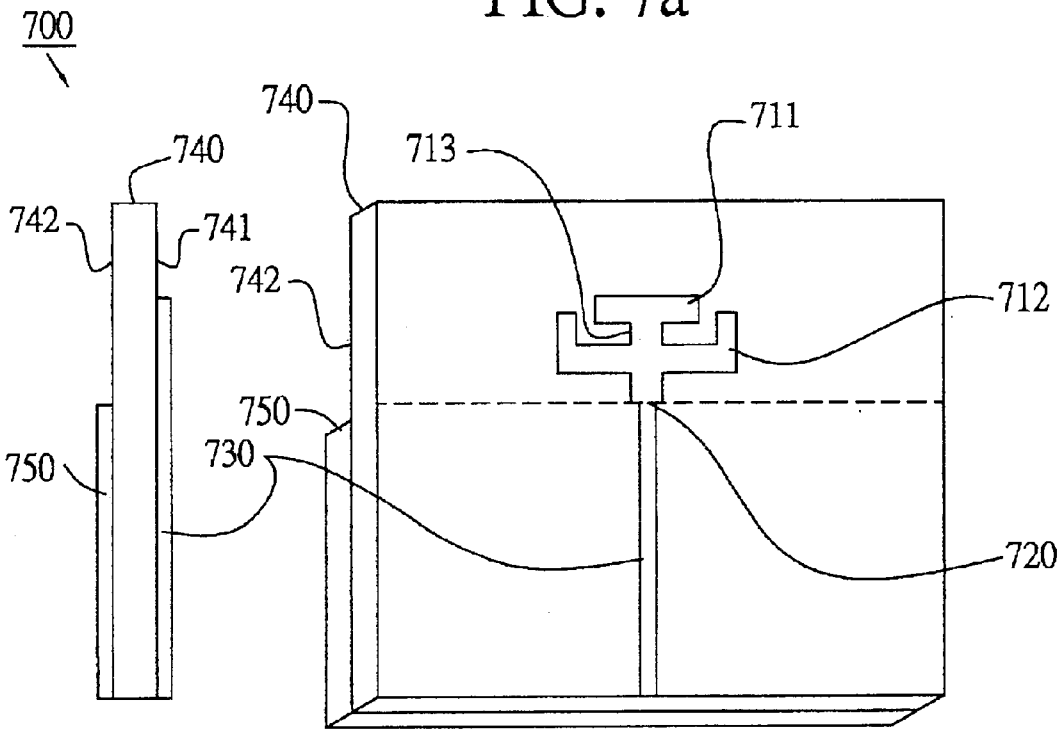

FIG. 7*a* through FIG. 7*b* depict sectional views and perspective views of the dual-band monopole antenna 700 of other embodiments in accordance with the present invention. As shown in FIG. 7*a*, the antenna 700 mainly comprising: a microwave substrate 40 with a first surface 741 and a second surface 742. The first surface 741 has a feeding metallic element 730. A first horizontal radiating metallic line 711 is printed on the first surface 741. A second horizontal radiating metallic line 712 is printed on the first surface 741 and below the first horizontal radiating metallic line 711. A vertical radiating metallic line 713 is printed on the first surface 741 and substantially perpendicular to the first horizontal radiating metallic line 711 and the second horizontal radiating metallic line 712. A feeding point 720 is disposed on the vertical radiating metallic line 713 for connecting the feeding metallic element 730 to the vertical radiating metallic line 713. A ground plane 750 is printed on the second surface 742, and the ground plane 750 has a rectangular or substantially rectangular breach, over which the antenna is directly disposed. In this embodiment, the middle point of the first horizontal radiating metallic line 711 is connected to one end of the vertical radiating metallic line 713 or the vicinity thereof opposite to the feeding point 720, while the middle point of the second horizontal radiating metallic line 712 is connected to the vertical radiating metallic line 713 at the position different from where the first horizontal radiating metallic line 711 is connected to, wherein the two ends (free ends) of the two horizontal radiating metallic lines 711 and 712 extend outwards in the opposite direction. Compared with the antenna 1 shown in FIG. 1, the two ends (free ends) of the two horizontal radiating metallic lines 711 and 712 may be bent upward or downward or created a certain angle with respect to the middle point of the horizontal radiating metallic line 711 and 712. The line width of the first horizontal radiating metallic line 711, the second horizontal radiating metallic line 712 and the vertical radiating metallic line 713 can be the same or different from each other. So the arrangement of the first horizontal radiating metallic line 711, the second horizontal radiating metallic line 712 and the vertical horizontal radiating metallic line 713 is more flexible, thereby enhancing the integration between the antenna and the system circuit of the microwave substrate 740.

While the foregoing description and drawings represent the preferred embodiments of the present invention, it should be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components. The presently disclosed embodiments are therefore to be considered in all respects as illustrative and not restrictive, the scope of the invention being a indicated by the appended claims and their legal equivalents, and not limited to the foregoing description.

What is claimed is:

1. A dual-band monopole antenna comprising:

a microwave substrate having a first surface and a second surface;

a ground plane formed on the second surface and having a breach;

a first horizontal radiating metallic line and a second horizontal radiating metallic line formed on the first surface above the breach;

a vertical radiating metallic line intersecting the first horizontal radiating metallic line and the second horizontal radiating metallic line respectively; and a feeding point disposed on a free end of the vertical radiating metallic line or the vicinity thereof.

2. The dual-band monopole antenna as claimed in claim 1, wherein a middle point of the first horizontal radiating metallic line is substantially connected to another free end of the vertical radiating metallic line, a middle point of the second horizontal radiating metallic line is connected to the vertical radiating metallic line at the position different from where the first horizontal radiating metallic line is connected to, and two free ends of the first and second horizontal radiating metallic lines respectively extend outwards in opposite direction, whereby the antenna is arranged in a substantially stacked double T shape.

3. The dual-band monopole antenna as claimed in claim 2, wherein the path from the feeding point through the vertical radiating metallic line to one free end of the first horizontal radiating metallic line forms the first resonant path of the antenna in operation and determines a first operating frequency thereof.

4. The dual-band monopole antenna as claimed in claim 2, wherein the path from the feeding point through the vertical radiating metallic line to one free end of the second horizontal radiating metallic line forms the second resonant path of the antenna in operation and determines a second operating frequency thereof.

5. The dual-band monopole antenna as claimed in claim 2, wherein the vertical radiating metallic line is substantially perpendicular to the first and second horizontal radiating metallic lines.

6. The dual-band monopole antenna as claimed in claim 2, wherein the two free ends of the first horizontal radiating metallic line are bent at a certain angle with respect to the middle point of the first horizontal radiating metallic line.

7. The dual-band monopole antenna as claimed in claim 2, wherein the two free ends of the second horizontal radiating metallic line are bent at a certain angle with respect to the middle point of the second horizontal radiating metallic line.

8. The dual-band monopole antenna as claimed in claim 2, wherein the two free ends of the first horizontal radiating metallic line are bent respectively at a certain angle with respect to the vertical radiating line.

9. The dual-band monopole antenna as claimed in claim 2, wherein the two free ends of the second horizontal radiating metallic line are bent respectively at a certain angle with respect to the vertical radiating line.

10. The dual-band monopole antenna as claimed in claim 1, further comprising:

a feeding metallic element formed on the first surface for connecting to the feeding point.

11. The dual-band monopole antenna as claimed in claim 1, wherein line widths of the first and the second horizontal radiating metallic line are the same.

12. A dual-band monopole antenna comprising:

a substrate having a first surface and a second surface being substantially parallel to said first surface;

a ground plane with a breach formed on said second surface;

a plurality of metallic lines arranged in a substantially stacked double-T shape having a first horizontal metallic line, a second horizontal metallic line and a vertical metallic line, and formed on said first surface above said breach for generating a first operating band and a second operating band; and a feeding point on a free end of said vertical metallic line.

13. The dual-band monopole antenna as claimed in claim 12, wherein said first and said second horizontal metallic lines have the same line width.

14. The dual-band monopole antenna as claimed in claim 12, wherein said first horizontal radiating metallic line is bent.

15. The dual-band monopole antenna as claimed in claim 12, wherein said second horizontal radiating metallic line is bent.

16. The dual-band monopole antenna as claimed in claim 12, wherein said breach is substantially rectangular.

17. The dual-band monopole antenna as claimed in claim 12, wherein said first operating band is about 2.4 GHz.

18. The dual-band monopole antenna as claimed in claim 12, wherein said second operating band is about 5.2 GHz.

19. The dual-band monopole antenna as claimed in claim 18, wherein said feeding metallic element is a microstrip line.

20. The dual-band monopole antenna as claimed in claim 12, further comprising:

a feeding metallic element formed on said first surface for connecting to said feeding point.

* * * * *